US007922890B2

(12) United States Patent
Sanchez et al.

(10) Patent No.: US 7,922,890 B2
(45) **Date of Patent: *Apr. 12, 2011**

(54) LOW MAINTENANCE ON-SITE GENERATOR

(75) Inventors: Justin Sanchez, Albuquerque, NM (US); Rodney E. Herrington, Albuquerque, NM (US)

(73) Assignee: MIOX Corporation, Albuquerque, NM (US)

( * ) Notice: Subject to any disclaimer, the term of this patent is extended or adjusted under 35 U.S.C. 154(b) by 662 days.

This patent is subject to a terminal disclaimer.

(21) Appl. No.: 11/946,772

(22) Filed: Nov. 28, 2007

(65) Prior Publication Data

US 2008/0237054 A1 Oct. 2, 2008

Related U.S. Application Data

(60) Provisional application No. 60/867,557, filed on Nov. 28, 2006.

(51) Int. Cl.
*C25B 1/34* (2006.01)

(52) U.S. Cl. ..... 205/346; 205/335; 205/345; 205/349; 205/508; 205/510; 205/620; 205/687; 204/242; 204/252; 204/263; 204/275.1; 204/229.6

(58) Field of Classification Search ..... 205/335, 205/345, 346, 349, 508, 620, 687; 204/242, 204/252, 263, 275.1, 228.3, 228.6, 229.6
See application file for complete search history.

(56) References Cited

U.S. PATENT DOCUMENTS

| | | | | |
|---|---|---|---|---|
| 3,234,110 | A | 2/1966 | Beer | |
| RE32,077 | E | 2/1986 | deNora et al. | |
| 4,710,233 | A | 12/1987 | Hohmann et al. | |
| 4,761,208 | A | 8/1988 | Gram et al. | |
| 4,767,511 | A * | 8/1988 | Aragon | 210/743 |
| 5,316,740 | A | 5/1994 | Baker et al. | |
| 5,385,711 | A | 1/1995 | Baker et al. | |
| 5,624,535 | A * | 4/1997 | Tsuchikawa et al. | 204/228.2 |
| 6,056,666 | A | 5/2000 | Williams | |
| 6,106,691 | A | 8/2000 | Nakamura et al. | |
| 6,309,523 | B1 | 10/2001 | Prasnikar et al. | |
| 6,514,401 | B2 | 2/2003 | Chyou et al. | |
| 6,524,475 | B1 | 2/2003 | Herrington et al. | |
| 6,736,966 | B2 | 5/2004 | Herrington et al. | |
| 2004/0195090 | A1 | 10/2004 | Omasa | |
| 2009/0229992 | A1 * | 9/2009 | Sanchez et al. | 205/687 |

FOREIGN PATENT DOCUMENTS

| | | |
|---|---|---|
| KR | 20020074262 | 9/2002 |
| WO | WO-83/00052 | 1/1983 |
| WO | WO-98/45503 | 10/1998 |

OTHER PUBLICATIONS

"Winter 2004 CBE Technical Advisory Conference", Feb. 5-6, 2004, Montana State University-Bozeman, Bozeman, Montana Feb. 2004.

Rabinovitch, Christine et al., "Removal and Inactivation of Staphylococcus epidermidis BioFilms by Electrolysis", *Applied and Environmental Microbiology* Sep. 2006 , 6364-6366.

* cited by examiner

*Primary Examiner* — Bruce F Bell

(74) *Attorney, Agent, or Firm* — Philip D. Askenazy; Peacock Myers, P.C.

(57) ABSTRACT

Method and apparatus for a low maintenance, high reliability on-site electrolytic generator incorporating automatic cell monitoring for contaminant film buildup, as well as automatically removing or cleaning the contaminant film. This method and apparatus preferably does not require human intervention to clean.

23 Claims, 1 Drawing Sheet

LOW MAINTENANCE ON-SITE GENERATOR

CROSS-REFERENCE TO RELATED APPLICATIONS

This application claims priority to and the benefit of filing of U.S. Provisional Patent Application Ser. No. 60/867,557, entitled "Low Maintenance On-Site Generator", filed on Nov. 28, 2006, which is incorporated herein by reference.

BACKGROUND OF THE INVENTION

1. Field of the Invention (Technical Field):

The present invention relates to an electrolytic on-site generator which is nearly free of maintenance.

2. Background Art:

Note that the following discussion refers to a number of publications and references. Discussion of such publications herein is given for more complete background of the scientific principles and is not to be construed as an admission that such publications are prior art for patentability determination purposes.

Electrolytic technologies utilizing dimensionally stable anodes have been developed to produce mixed-oxidants and sodium hypochlorite solutions from a sodium chloride brine solution. Dimensionally stable anodes are described in U.S. Pat. No. 3,234,110 to Beer, entitled "Electrode and Method of Making Same," wherein a noble metal coating is applied over a titanium substrate. Electrolytic cells have had wide use for the production of chlorine and mixed oxidants for the disinfection of water. Some of the simplest electrolytic cells are described in U.S. Pat. No. 4,761,208, entitled "Electrolytic Method and Cell for Sterilizing Water", and U.S. Pat. No. 5,316,740, entitled "Electrolytic Cell for Generating Sterilizing Solutions Having Increased Ozone Content."

Electrolytic cells come in two varieties. The first category comprises divided cells that utilize membranes to maintain complete separation of the anode and cathode products in the cells. The second category comprises undivided cells that do not utilize membranes, but that also do not suffer nearly as much from issues associated with membrane fouling. However, it is well accepted that one of the major failure mechanisms of undivided electrolytic cells is the buildup of unwanted films on the surfaces of the electrodes. The source of these contaminants is typically either from the feed water to the on-site generation process or contaminants in the salt that is used to produce the brine solution feeding the system. Typically these unwanted films consist of manganese, calcium carbonate, or other unwanted substances. If buildup of these films is not controlled or they are not removed on a fairly regular basis, the electrolytic cells will lose operating efficiency and will eventually catastrophically fail (due to localized high current density, electrical arcing or some other event). Typically, manufacturers protect against this type of buildup by incorporating a water softener on the feed water to the system to prevent these contaminants from ever entering the electrolytic cell. However, these contaminants will enter the process over time from contaminants in the salt used to make the brine. High quality salt is typically specified to minimize the incidence of cell cleaning operations. Processes are well known in the art for purifying salt to specification levels that will avoid contaminants from entering the cell. However, these salt cleaning processes, although mandatory for effective operation of divided cells, are considered too complicated for smaller on-site generation processes that utilize undivided cells.

U.S. patent application Ser. No. 11/287,531, which is incorporated herein by reference, is directed to a carbonate detector and describes one possible means of monitoring an electrolytic cell for internal film buildup. Other possible means for monitoring carbonate buildup in cells that utilize constant current control schemes is by monitoring the rate of brine flow to the cell. As brine flow increases, it is usually, but not always, indicative of carbonate formation on the cathode electrode which creates electrical resistance in the cell. Other than these methods and/or visual inspection of the internal workings of a cell, there currently is not an adequate method of monitoring the internal status of the buildup on an electrolytic cell.

The current accepted method of cleaning an electrolytic cell is to flush it with an acid (often muriatic or hydrochloric acid) to remove any deposits which have formed. Typically, manufacturers recommend performing this action on a regular basis, at least yearly, but sometimes as often as on a monthly basis. Thus there is a need for a more reliable method for insuring cleanliness of the electrolytic cell is to perform a cleaning process on an automated basis that does not require the use of a separate supply of consumables such as muriatic or hydrochloric acid, and that does not require operator intervention.

SUMMARY OF THE INVENTION

Disclosure of the Invention

The present invention is a method for operating an electrolytic cell, the method comprising the steps of supplying brine to an electrolytic cell, producing one or more oxidants in the electrolytic cell, detecting a level of contaminant buildup, automatically stopping the brine supply after an upper contaminant threshold is detected, automatically cleaning the electrolytic cell, thereby reducing contaminants in the electrolytic cell, and automatically continuing to produce the one or more oxidants after a lower contaminant threshold is detected. The cleaning step preferably comprises providing brine to an acid generating electrolytic cell, generating an acid in the acid generating electrolytic cell, and introducing the acid into the electrolytic cell. The acid preferably comprises muriatic acid or hydrochloric acid. The method preferably further comprises the step of diluting the brine. The detecting step preferably comprises utilizing a carbonate detector. The detecting step preferably comprises measuring the rate of brine consumption in the electrolytic cell, optionally by measuring a quantity selected from the group consisting of flow meter output, temperature of the electrolytic cell, brine pump velocity, and incoming water flow rate. The method preferably further comprises comparing the rate of brine consumption to the rate of brine consumption in a clean electrolytic cell. The cleaning step optionally comprises using an ultrasonic device and/or using a magnetically actuated mechanical electrode cleaning device, or reversing the polarity of electrodes in the electrolytic cell, thereby lowering the pH at a cathode.

The present invention is also an apparatus for producing an oxidant, the apparatus comprising a brine supply, an electrolytic cell, an acid supply, and a control system for automatically introducing acid from the acid supply into the electrolytic cell. The acid supply preferably comprises a second electrolytic cell, and the brine supply preferably provides brine to the second electrolytic cell during a cleaning cycle. The apparatus preferably further comprises a variable speed brine pump, a carbonate detector, one or more thermowells for measuring a temperature of said electrolytic cell, and/or one or more flowmeters for measuring the brine flow rate.

The present invention is also an apparatus for producing an oxidant, the apparatus comprising a brine supply, an electrolytic cell, a cleaning mechanism in the electrolytic cell, and a control system for automatically activating the cleaning mechanism. The cleaning mechanism preferably is selected from the group consisting of ultrasonic horn, magnetically actuated electrode mechanical cleaning device, and acidic solution at a cathode surface. The apparatus preferably further comprises a device selected from the group consisting of a carbonate detector, at least one thermowell for measuring a temperature of said electrolytic cell, and a flowmeter for measuring a brine flow rate.

The present invention is a method and device whereby an on-site generator electrolytic cell is preferably monitored automatically for buildup of contaminants on the electrode surfaces, and when those contaminants are detected, the electrolytic cell is cleaned automatically (i.e., without operator intervention), thereby providing a simple, low cost, and reliable process for achieving a highly reliable, low maintenance, on-site generator which does not require the typical operator intervention and/or auxiliary equipment (such as a water softener) now required for long life of electrolytic cells. A carbonate detector integrated with an electrolytic cell, automatic acid washing, and device controls may be utilized.

The internal status of the electrolytic cells can be monitored automatically by monitoring cell inputs and performance. It is known that how much brine a cell consumes is dependent on the amount and type of film buildup on that given cell. If brine flow is continuously monitored, any dramatic change in brine flow to reach a given current at a given voltage is indicative of a potential problem with film buildup within a cell. The invention preferably monitors the flow characteristics of the brine, incoming water, temperature, etc., to determine whether or not there has been contaminant buildup within the electrolytic cell. When potential film buildup is detected in the cell by the control system, the cell is preferably automatically acid washed.

A separate electrolytic cell from the one used to create the mixed oxidant or sodium hypochlorite is preferably used to create the acid on site and on demand and to provide the acid for removing of contaminants in the electrolytic cell used for creating the sodium hypochlorite or mixed oxidants. Alternatively a reservoir is used to store concentrated acid onsite for cleaning the cell, and monitoring that acid reservoir and alarming operators when that acid reservoir would need to be refilled, as well as optionally diluting the acid to a desired concentration prior to washing the cell. An ultrasonic cleaning methodology for automatically removing unwanted contaminants when said contaminants are detected by the methods described above may also be integrated into the present invention.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawing, which is incorporated into and form a part of the specification, illustrates an embodiment of the present invention and, together with the description, serves to explain the principles of the invention. The drawing is only for the purpose of illustrating a preferred embodiment of the invention and is not to be construed as limiting the invention. In the drawings.

DESCRIPTION OF THE PREFERRED EMBODIMENTS

Figure 1:
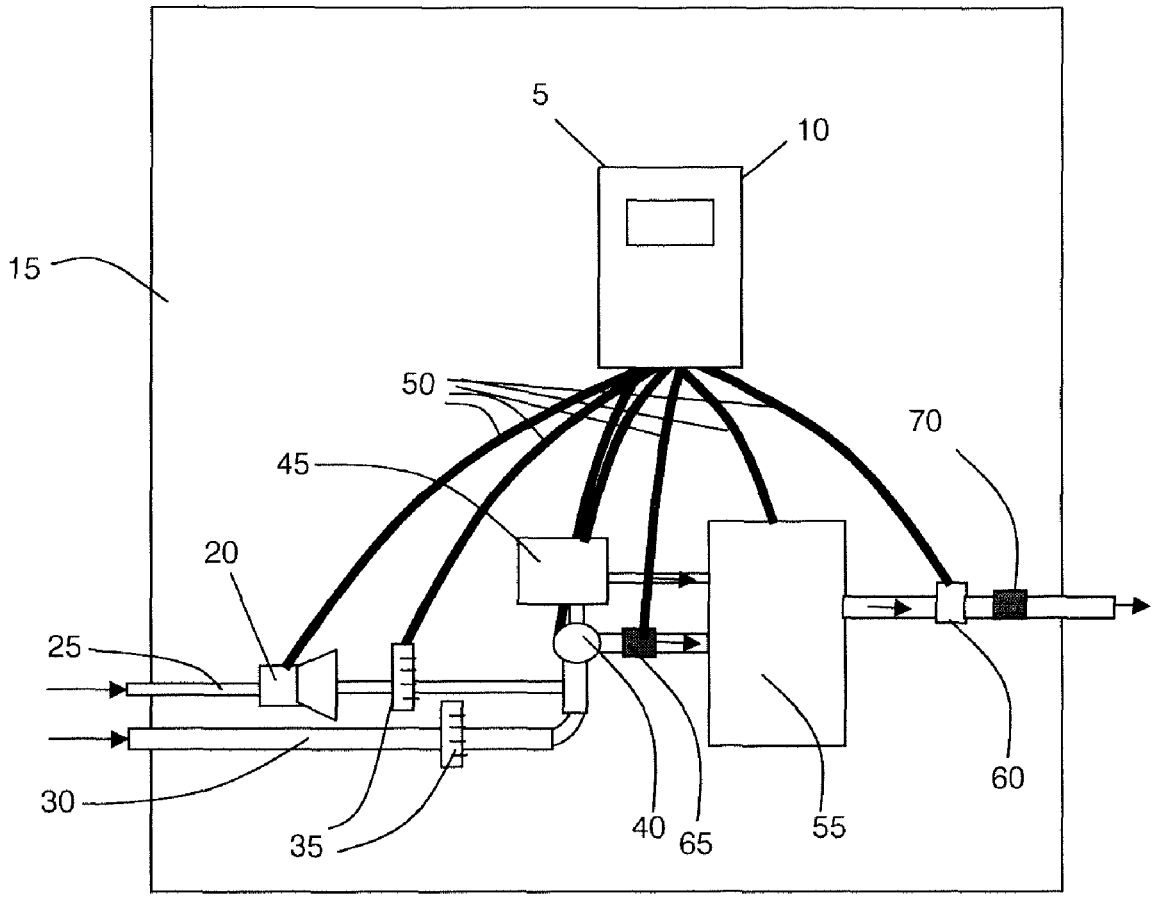
FIG. 1 is a diagram of one embodiment of a low maintenance on-site generator unit.

Best Modes for Carrying Out the Invention

An embodiment of the present invention is shown in FIG. 1. All of the components of this device are preferably mounted to back plate 15. The controls and power supplies for all the separate components shown in this embodiment are all preferably contained within control box 5, but may alternatively be located wherever it is convenient, preferably as long as there are master controls for the overall operation of the apparatus.

Control box 5 preferably shows the status of the unit via display 10, and the master controls as well as electrical power and/or component signals are preferably carried via electrical connections 50 between control box 5 and the various individual components. Water preferably enters the system through water entrance pipe 30, and brine preferably enters the system through brine entrance pipe 25. Brine, preferably stored in a saturated brine silo or tank, is preferably pumped via variable speed brine pump 20, which is preferably controlled and powered by electrical connection 50. The brine then preferably passes through flow meter 35, which can be electrically monitored via electrical connection 50. The control system can control the flow rate of the brine by increasing the speed of variable speed brine pump 20.

Data from any of the following sources (or combinations of data from any of these sources) is preferably used to determine the volumetric flow rate of brine: flow meter 35, carbonate detector 60, electrolytic cell 55, acid generating electrolytic cell 45, and/or thermowell 65. Valve 40 can direct flow either to electrolytic cell 55 or to acid generating electrolytic cell 45. Valve 40 typically flows an electrolyte comprising diluted brine (as both the concentrated brine and water inflows have preferably been plumbed together and the brine has been diluted before it reaches valve 40) to electrolytic cell 55. In this standard operating configuration, the system produces, for example, mixed oxidants or sodium hypochlorite.

As contaminants build up on carbonate detector 60, which may be located elsewhere according to the present invention, carbonate detector 60 sends a series of signals to control box 5, preferably via electrical connections 50, which indicate whether or not a contaminant film is building up on electrolytic cell 55. When carbonate detector 60 indicates that there is contaminant film, control box 5 preferably begins an acid cleaning cycle in the device, wherein valve 40 is actuated via electrical connection 50 to force diluted brine through acid generating cell 45, which is also preferably energized by control box 5 via electrical connections 50. The system preferably runs brine pump 20 to flow at a rate (as measured by flow meters 35) which has been optimized for optimal acid creation in acid generating electrolytic cell 45. In this embodiment, the acid created in acid generation cell 45 preferably flows through electrolytic cell 55, where it preferably cleans the contaminants, then flows through carbonate detector 60. The system preferably runs in this acid cleaning mode until carbonate detector 60 sends a signal to control box 5 indicating that the system is clean and can begin running again in standard mixed oxidant or sodium hypochlorite production mode. The acid used to clean electrolytic cell 55 is preferably dumped to a separate waste drain after flowing through carbonate detector 60 instead of dumping it to the oxidant storage tank.

Electrolytic cell 55 may optionally be cleaned with an ultrasonic horn, a magnetically actuated electrode mechanical cleaning apparatus, and/or reversing the polarity of the electrodes in electrolytic cell 55 (typically while flowing electrolyte through electrolytic cell 55, and preferably for a very short duration) in addition to or in place of using an acid generating cell. Reversing the polarity of the electrodes, preferably at low current densities, lowers the pH at the cathode, which dissolves and removes the contaminants.

In an alternative embodiment, concentrated acid is stored in a reservoir. During the acid cleaning cycle, control box 5 preferably activates a pump or valve to allow flow of the acid to electrolytic cell 55. The reservoir is preferably large enough to accommodate many different acid wash cycles. Some of that acid may potentially be diluted with standard incoming water to clean electrolytic cell 55.

If carbonate detector 60 (or any other contaminant detecting component) is not used, electrolytic cell 55 is preferably cleaned on a very aggressive schedule to ensure contaminants do not ruin electrolytic cell 55.

The rate of brine consumption may optionally be used to determine the presence of contaminants in electrolytic cell 55. In normal operation in a clean cell, the rate of brine consumption is steady and measurable. As carbonate scale builds up within electrolytic cell 55, the carbonate layer acts as an electrical insulator between the anode and cathode within electrolytic cell 55. To compensate for this insulating effect, and to maintain the amperage within electrolytic cell 55, the rate of brine consumption increases to increase the conductivity within electrolytic cell 55. This increased rate of brine consumption is compared to the normal rate of brine consumption. Flow through electrolytic cell 55 can also be used to measure contaminant buildup within electrolytic cell 55. Flow can be measured indirectly by measuring the temperature rise through electrolytic cell 55, for example by comparing the temperature difference between thermowell 65 and cell discharge thermowell 70. When carbonate buildup is detected by any of these means, electrolytic cell 55 can be cleaned by any of the methods or components described above. Brine consumption may be measured using brine flow rate, tachometer rates of brine pump 20, or incoming water flow rates.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all patents and publications cited above are hereby incorporated by reference.

What is claimed is:

1. A method for operating an electrolytic cell, the method comprising the steps of:
- supplying brine to an electrolytic cell;
- producing one or more oxidants in the electrolytic cell;
- automatically cleaning the electrolytic cell, thereby reducing contaminants in the electrolytic cell; and
- subsequently automatically continuing to produce the one or more oxidants.

2. The method of claim 1 wherein the cleaning step comprises:
- providing brine to an acid generating electrolytic cell;
- generating an acid in the acid generating electrolytic cell; and
- introducing the acid from the acid generating electrolytic cell into the electrolytic cell.

3. The method of claim 2 wherein the acid comprises muriatic acid or hydrochloric acid.

4. The method of claim 1 further comprising the step of diluting the brine.

5. The method of claim 1 wherein the detecting step comprises utilizing a carbonate detector.

6. The method of claim 1 wherein the detecting step comprises measuring a rate of brine consumption in the electrolytic cell.

7. The method of claim 6 comprising measuring a quantity selected from the group consisting of flow meter output, temperature of the electrolytic cell, brine pump velocity, and incoming water flow rate.

8. The method of claim 6 further comprising comparing the rate of brine consumption to a rate of brine consumption in a clean electrolytic cell.

9. The method of claim 1 wherein the cleaning step comprises using an ultrasonic device and/or using a magnetically actuated mechanical electrode cleaning device.

10. The method of claim 1 wherein the cleaning step comprises reversing a polarity of electrodes in the electrolytic cell, thereby lowering the pH at a cathode.

11. The method of claim 1 further comprising:
- detecting a level of contaminant buildup; and
- automatically stopping the brine supply after an upper contaminant threshold is detected.

12. The method of claim 11 wherein the step of subsequently automatically continuing to produce the one or more oxidants is performed after a lower contaminant threshold is detected.

13. The method of claim 1 wherein the cleaning step is performed periodically.

14. An apparatus for producing an oxidant, the apparatus comprising:
- a brine supply;
- an electrolytic cell;
- an acid supply; and
- a control system for automatically introducing acid from said acid supply into said electrolytic cell, thereby cleaning said electrolytic cell.

15. The apparatus of claim 14 wherein said acid supply comprises a second electrolytic cell.

16. The apparatus of claim 15 wherein said brine supply provides brine to said second electrolytic cell during a cleaning cycle.

17. The apparatus of claim 14 further comprising a variable speed brine pump.

18. The apparatus of claim 14 further comprising a carbonate detector.

19. The apparatus of claim 14 further comprising one or more thermowells for measuring a temperature of said electrolytic cell.

20. The apparatus of claim 14 further comprising one or more flowmeters for measuring a brine flow rate.

21. An apparatus for producing an oxidant, the apparatus comprising:
- a brine supply;
- an electrolytic cell;
- a cleaning mechanism in said electrolytic cell; and
- a control system for automatically activating said cleaning mechanism.

22. The apparatus of claim 21 wherein said cleaning mechanism is selected from the group consisting of ultrasonic horn, magnetically actuated electrode mechanical cleaning device, and acidic solution at a cathode surface.

23. The apparatus of claim 21 further comprising a device selected from the group consisting of a carbonate detector, at least one thermowell for measuring a temperature of said electrolytic cell, and a flowmeter for measuring a brine flow rate.

* * * * *